US007668295B2

(12) United States Patent
Tang et al.

(10) Patent No.: US 7,668,295 B2
(45) Date of Patent: Feb. 23, 2010

(54) SYSTEM AND METHOD FOR HIGH VOLTAGE TRANSIENT SUPPRESSION AND SPIT PROTECTION IN AN X-RAY TUBE

(75) Inventors: Liang Tang, Waukesha, WI (US); Philippe Ernest, Gif sur Yvette (FR); Georges-William Baptiste, Buc (FR); Fengfeng Tao, Clifton Park, NY (US)

(73) Assignee: General Electric Co., Schenectady, NY (US)

( * ) Notice: Subject to any disclaimer, the term of this patent is extended or adjusted under 35 U.S.C. 154(b) by 135 days.

(21) Appl. No.: 11/748,009

(22) Filed: May 14, 2007

(65) Prior Publication Data

US 2008/0285716 A1 Nov. 20, 2008

(51) Int. Cl.
*H05G 1/10* (2006.01)

(52) U.S. Cl. ..... 378/101; 378/117

(58) Field of Classification Search ..... 378/117, 378/136, 138, 139, 104, 105, 106, 107, 101
See application file for complete search history.

(56) References Cited

U.S. PATENT DOCUMENTS 4,559,640 A * 12/1985 Le Guen et al. ..... 378/113
4,768,215 A 8/1988 Kiwaki et al.
5,159,697 A 10/1992 Wirth
5,241,260 A 8/1993 Beland
5,495,165 A * 2/1996 Beland ..... 323/270
6,212,256 B1 4/2001 Miesbauer et al.
6,362,415 B1 3/2002 Snyder et al.
6,452,477 B1 9/2002 Roca et al.
6,466,645 B1 10/2002 Hsieh et al.
6,798,865 B2 9/2004 Tang
6,901,136 B1 5/2005 Tekletsadik et al.
6,922,463 B2 7/2005 Tang et al.
6,975,698 B2 12/2005 Katcha et al.
2006/0078088 A1 4/2006 Tang

* cited by examiner

*Primary Examiner*—Hoon Song

(57) ABSTRACT

A system and method to improve the high voltage performance of an x-ray tube with electrostatic deflection of an electron beam focal spot. The system and method provides protection of bias circuits from high voltage transients and spit protection in x-ray tubes through the use of a high voltage transient suppression and spit protection circuit assembly coupled between the bias circuits of a high voltage generator and an x-ray tube vacuum housing of an x-ray generation system.

12 Claims, 5 Drawing Sheets

SYSTEM AND METHOD FOR HIGH VOLTAGE TRANSIENT SUPPRESSION AND SPIT PROTECTION IN AN X-RAY TUBE

BACKGROUND OF THE INVENTION

This disclosure relates generally to x-ray generation systems. In particular, this disclosure relates to systems and methods for protection of bias circuits from high voltage transients and discharge/spit protection in x-ray tubes.

An x-ray tube generally includes a cathode assembly and an anode assembly disposed within a vacuum vessel. The anode assembly includes an anode having a target track or impact zone that is generally fabricated from a refractory metal with a high atomic number, such as tungsten or a tungsten alloy. The anode is commonly a rotating disk. The cathode assembly is positioned at some distance from the anode assembly creating a vacuum gap between the cathode assembly and the anode assembly, and a high voltage potential difference is maintained therebetween. The cathode assembly emits electrons in the form of an electron beam that are accelerated across the potential difference and impact the target track at a focal spot of the anode at a high velocity. As the electrons impact the target track, the kinetic energy of the electrons is converted to high-energy electromagnetic radiation, or x-rays. The x-rays are then transmitted through an object such as the body of a patient and are intercepted by a detector that forms an image of the objects internal anatomy.

In an x-ray tube, the focal spot can be controlled and deflected electrostatically through bias voltages. This is accomplished by applying different bias voltages at a number of electrodes within the cathode assembly. The cathode assembly generally includes at least two pairs of electrodes positioned on opposite sides of the cathode filament to control the size and deflection of the electron beam. A bias voltage is independently applied to each of the electrodes to focus and/or deflect the electron beam. In an x-ray tube with focal spot wobbling, the focal spot is wobbled electrostatically between two positions on a target track of an anode during a scan sequence. Electrically isolating the cathode septum and applying a continuously varying bias voltage to the cathode filament provides two unique focal spots that can be controlled with bias voltages. It is generally preferable to minimize the bias voltages at the electrodes to reduce the risk of insulation breakdown and improve reliability of the x-ray tube.

One of the potential problems in an x-ray tube is that there are considerable high voltage transients induced across the bias circuits, resulting in possible damage of the high voltage cable assembly and certain components within the high voltage generator, when a spit (either a vacuum discharge or a vacuum arc) occurs. A typical high voltage transient within the bias circuits could be as high as several tens of kilovolts for an x-ray tube. This presents a serious reliability problem, as the basic insulation level for the minor insulation along the bias circuits is not high enough to withstand these high voltage transients.

Therefore, there is a need for a system and method that prevents the occurrence of high voltage transients within an x-ray tube, and in particular provides protection of bias circuits from high voltage transients and spit protection in x-ray tubes.

BRIEF DESCRIPTION OF THE INVENTION

In an exemplary embodiment, an x-ray generation system comprising an x-ray tube vacuum housing with a cathode assembly spaced apart from an anode assembly, a high voltage generator coupled to the x-ray tube vacuum housing providing a plurality of bias voltages from a plurality of bias circuits for controlling an electron beam from the cathode assembly to a focal spot on the anode assembly, and a high voltage transient suppression and spit protection circuit assembly coupled between the high voltage generator and the x-ray tube vacuum housing for protection of the plurality of bias circuits within the x-ray generation system.

In an exemplary embodiment, a high voltage transient suppression and spit protection circuit assembly for protecting a plurality of bias circuits in an x-ray generation system comprising at least one transient suppression device coupled between each of the plurality of bias circuits and a high voltage common return; and at least one transient suppression device coupled between a filament drive circuit and the high voltage common return.

In an exemplary embodiment, a method for high voltage transient suppression and spit protection in an x-ray generation system comprising providing an high voltage transient suppression and spit protection circuit assembly coupled to a plurality of bias circuits within the x-ray generation system to suppress high voltage transients within the x-ray generation system; by reducing induced voltages within the x-ray generation system through limiting transient current with the use of surge resistors; clamping transient voltages through the use of transient suppression devices; and diverting high surge currents from entering high voltage generator circuitry within the x-ray generation system causing component failure of the high voltage generator circuitry.

Various other features, objects, and advantages of the invention will be made apparent to those skilled in the art from the accompanying drawings and detailed description thereof.

DETAILED DESCRIPTION OF THE INVENTION

Figure 1:
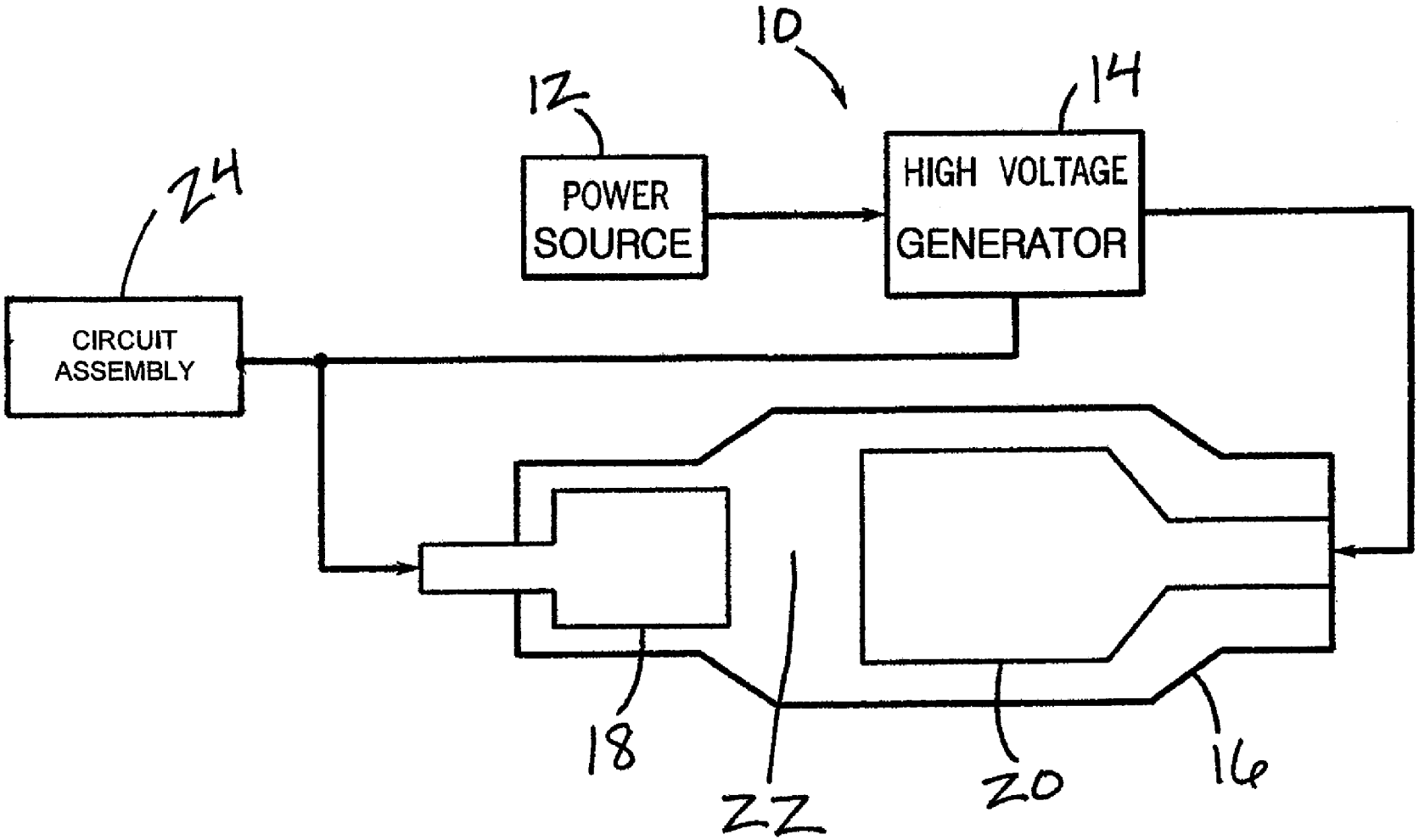
FIG. 1 is a schematic diagram of an exemplary embodiment of an x-ray generation system.

Referring now to the drawings, FIG. 1 illustrates a schematic diagram of an exemplary embodiment of an x-ray generation system 10. The x-ray generation system 10 includes a power source 12 coupled to and providing power to a high voltage generator 14, the high voltage generator 14 coupled to and providing a high voltage potential difference between a cathode assembly 18 and an anode assembly 20 in an x-ray tube vacuum housing 16. The cathode assembly 18 is located opposite the anode assembly 20 within the x-ray tube vacuum housing 16, and the cathode assembly 18 and anode assembly 20 are separated by a vacuum gap 22 located therebetween. The x-ray generation system 10 further includes a high voltage transient suppression and spit protection circuit assembly 24 comprising a plurality of electrical components located within a high voltage cable assembly coupled between the high voltage generator 14 and the x-ray tube vacuum housing 16, either of two high voltage connectors positioned at opposite ends of the high voltage cable assembly, or the cathode assembly 18.

The power source 12 is an AC power source that provides AC power to the high voltage generator 14. The high voltage generator 14 is designed to receive AC power from the power source 12 and provide a DC high voltage potential difference between the cathode assembly 18 and anode assembly 20 within the x-ray tube housing 16 where the cathode assembly 18 and anode assembly 20 carry equal voltages of different polarity. The high voltage generator 14 also provides a filament drive current for an electron-emitting filament within the cathode assembly 18 and bias voltages for controlling an electron beam from the cathode assembly to the anode assembly.

The cathode assembly 18 includes an electron-emitting filament that is capable of emitting electrons. In order to generate the x-rays, the high voltage generator 14 provides power to a filament drive circuit that generates a current through the filament in the cathode assembly 18. The filament is heated to incandescence and releases electrons. The electrons are accelerated across the vacuum gap 22 by the high voltage potential difference between the cathode assembly 18 and anode assembly 20 in an electron beam and strike a target track on the anode assembly 20 producing x-rays.

Figure 2:
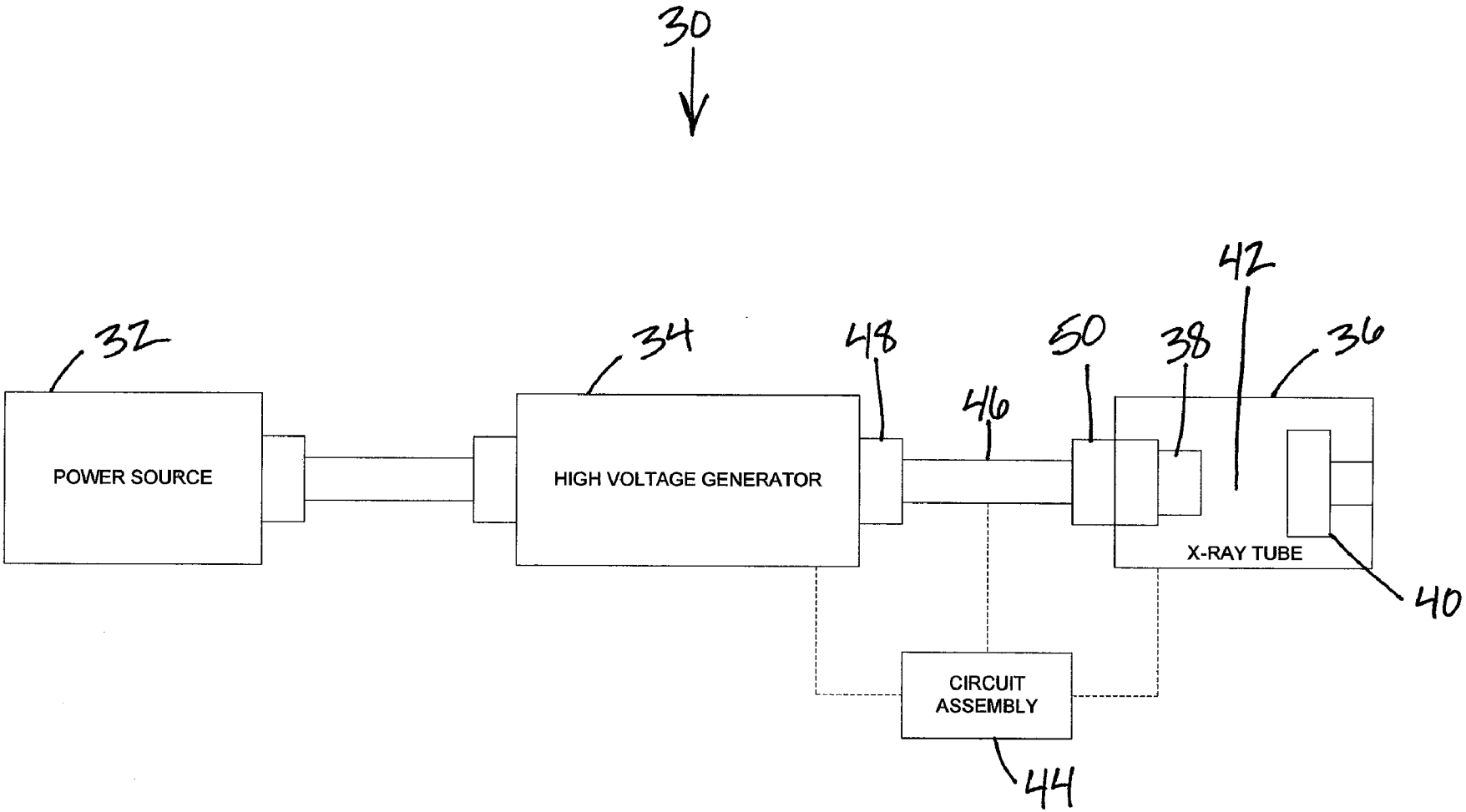
FIG. 2 is a schematic diagram of an exemplary embodiment of an x-ray generation system.

FIG. 2 illustrates a schematic diagram of an exemplary embodiment of an x-ray generation system 30. The x-ray generation system 30 includes a power source 32 coupled to and providing power to a high voltage generator 34, the high voltage generator 34 coupled to and providing a high voltage potential difference between a cathode assembly 38 and an anode assembly 40 in an x-ray tube vacuum housing 36. The cathode assembly 38 is located opposite the anode assembly 40 within the x-ray tube vacuum housing 36, and the cathode assembly 38 and anode assembly 40 are separated by a vacuum gap 42 located therebetween. The x-ray generation system 30 further includes a high voltage transient suppression and spit protection circuit assembly 44 comprising a plurality of electrical components located within a high voltage cable assembly 46 coupled between the high voltage generator 34 and the x-ray tube vacuum housing 36, either of two high voltage connectors 48, 50 positioned at opposite ends of the high voltage cable assembly 46, or the cathode assembly 38.

A plurality of high voltages and currents are supplied to the cathode assembly 38 from the high voltage generator 34 through the high voltage cable assembly 46. The high voltage cable assembly 46 connects the high voltage generator 34 with the x-ray tube vacuum housing 36. High voltage connectors 48, 50 are attached to each end of the high voltage cable assembly 46. The high voltage generator 34 supplies the high voltage potential difference between the cathode assembly 38 and the anode assembly 40, the filament drive current, and bias voltages for controlling the electron beam from the cathode assembly 38 to the anode assembly 40. The high voltage transient suppression and spit protection circuit assembly 44 designed for protection of bias circuits within the high voltage generator 34 may be integrated within the high voltage cable assembly 46, either of the high voltage connectors 48, 50, or cathode assembly 38.

The cathode assembly 38 includes an electron-emitting filament that is capable of emitting electrons. In order to generate the x-rays, the high voltage generator 34 provides power to a filament drive circuit that generates a current through the filament in the cathode assembly 38. The filament is heated to incandescence and releases electrons. The electrons are accelerated across the vacuum gap 42 by the high voltage potential difference between the cathode assembly 38 and anode assembly 40 in an electron beam and strike a target track on the anode assembly 40 producing x-rays.

Figure 3:
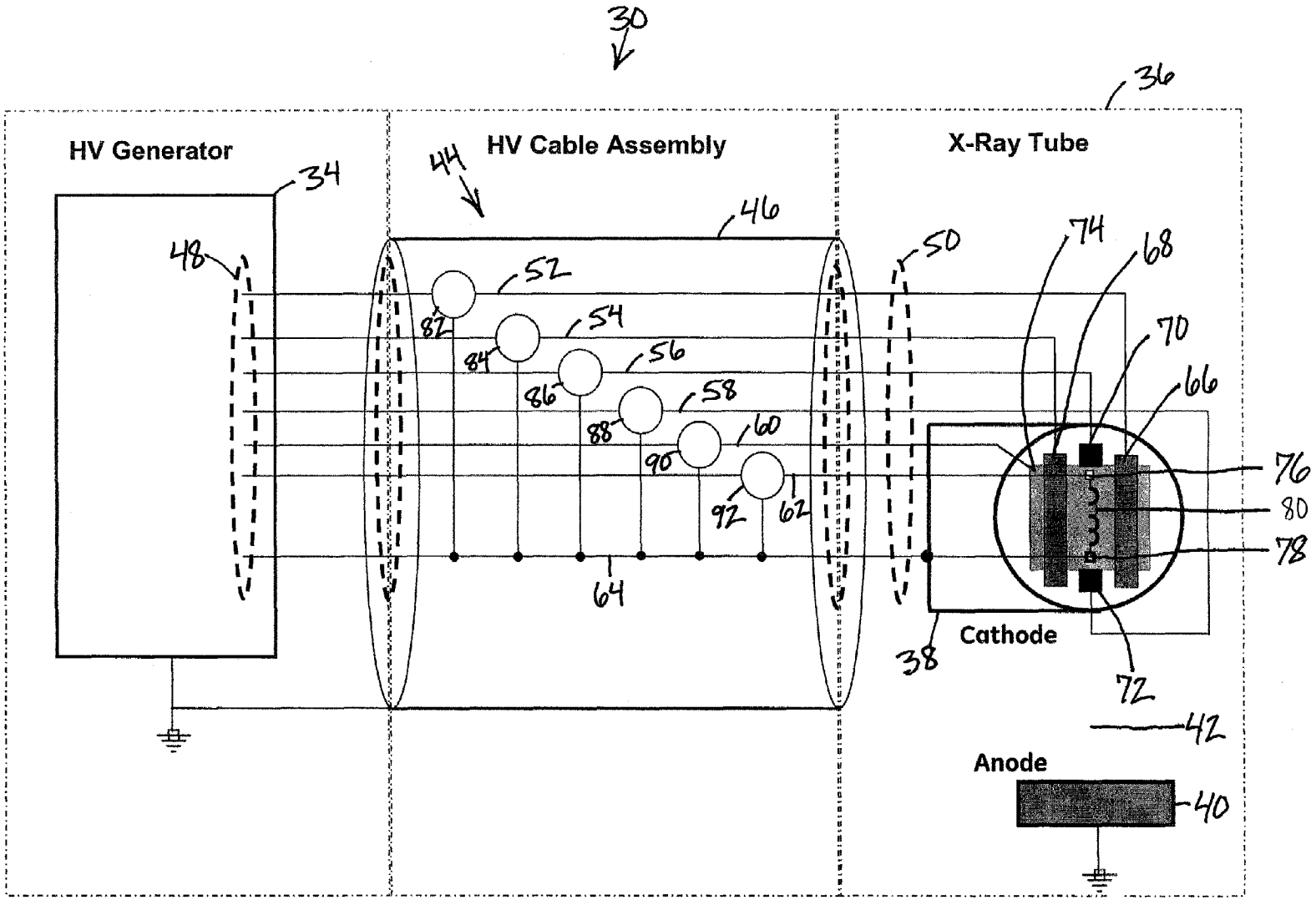
FIG. 3 is a more detailed schematic diagram of a portion of the exemplary embodiment of the x-ray generation system of FIG. 2.

FIG. 3 illustrates a more detailed schematic diagram of a portion of the exemplary embodiment of the x-ray generation system 30 of FIG. 2. The x-ray generation system 30 includes an electron beam deflection system for focal spot control and deflection of the electron beam on a target track of the anode assembly 40. The electron beam focal spot is controlled and deflected electrostatically through a plurality of bias voltages supplied by bias circuits in the high voltage generator 34 and applied to a plurality of electrodes on the cathode assembly 38. This is accomplished by applying a plurality of different bias voltages from the high voltage generator 34 through the high voltage cable assembly 46 to a plurality of electrodes on the cathode assembly 38. There is the possibility of high voltage transients being induced across the bias circuitry, resulting in possible damage of the high voltage cable assembly 46 and components within the high voltage generator 34, when a spit (either a vacuum discharge or a vacuum arc) occurs.

The x-ray generation system 30 includes a high voltage transient suppression and spit protection circuit assembly 44 integrated within the high voltage cable assembly 46, either of the high voltage connectors 48, 50, or cathode assembly 38. The high voltage transient suppression and spit protection circuit assembly 44 is designed to suppress and prevent high voltage transients from occurring across the bias control circuits caused by vacuum discharges or vacuum arcs (spits).

The high voltage generator 34 supplies a plurality of high voltages to the cathode assembly 38 through the high voltage cable assembly 46. The high voltage cable assembly 46 connects a high voltage generator 34 with an x-ray tube vacuum housing 36. High voltage connectors 48, 50 are attached to each end of the high voltage cable assembly 46. The high voltage generator 34 provides the high voltage potential difference between the cathode assembly 38 and the anode assembly 40, power to a filament drive circuit that generates a current through the filament 80 in the cathode assembly 38, and bias voltages for controlling the electron beam from the cathode assembly 38 to the anode assembly 40.

The high voltage generator 34 includes a plurality of bias control circuits and terminals for providing bias voltages to the cathode assembly 38 to control the size and deflection of the electron beam by providing a plurality of bias voltages to a plurality of electrodes in the cathode assembly. The electron beam focal spot may be wobbled electrostatically between different positions on a target track of the anode assembly 40 during a scan sequence. Electrically isolating the cathode septum and applying a continuously varying bias voltage to the cathode filament provides unique focal spots that can be controlled with bias voltages supplied by the high voltage generator 34 and through a plurality of conductors in the high voltage cable assembly 46.

The high voltage cable assembly 46 comprises a plurality of electrical conductors 52, 54, 56, 58, 60, 62, 64 positioned within the cable assembly and extending therethrough with a layer of high voltage insulation surrounding each conductor. The plurality of conductors 52, 54, 56, 58, 60, 62, 64 comprise at least two conductors 52 (width 1 conductor), 54 (width 2 conductor) providing bias voltages to control focal spot width, at least two conductors 56 (length 1 conductor), 58 (length 2 conductor) providing bias voltages to control focal spot length, at least one conductor 60 (focusing conductor) providing a bias voltage to control focusing and/or deflection of the focal spot (focal spot wobbling), at least one conductor 62 (filament conductor) providing filament drive current, and at least one conductor 64 providing a high voltage common return. The high voltage cable assembly 46 further comprises a first high voltage connector 48 at one end thereof for connecting the high voltage cable assembly 46 to the high voltage generator 34 and a second high voltage connector 50 at the opposite end thereof for connecting the high voltage cable assembly 46 to the x-ray tube vacuum housing 36.

The high voltage transient suppression and spit protection circuit assembly 44 comprises a plurality of transient suppression circuit components or devices 82, 84, 86, 88, 90, 92 coupled to each conductor 52, 54, 56, 58, 60, 62 between the high voltage generator 34 and the cathode assembly 38. Examples of high voltage transient suppression and spit protection circuit assemblies with a plurality of transient suppression circuit components or devices are shown in FIGS. 4-6.

The cathode assembly 38 includes an electron-emitting filament 80 and a plurality of electrodes 66, 68, 70, 72, 74, 76, 78 positioned on opposite sides and ends of the cathode filament 80 to control the size and deflection of the electron beam focal spot. A plurality of bias voltages are applied to the plurality of electrodes 66, 68, 70, 72, 74, 76, 78 in the cathode assembly 38 and the anode assembly is grounded. A bias voltage is independently applied to each of the electrodes 66, 68, 70, 72, 74, 76, 78 to focus and/or deflect the electron beam.

The plurality of electrodes 66, 68, 70, 72, 74, 76, 78 comprise at least two electrodes 66 (width 1 electrode), 68 (width 2 electrode) on opposite sides of the filament 80 to control focal spot width, at least two electrodes 70 (length 1 electrode), 72 (length 2 electrode) on opposite ends of the filament 80 to control focal spot length, at least one electrode 74 (focusing electrode) to control focusing and/or deflection of the focal spot (focal spot wobbling), an electrode 76 (filament 1 electrode) connected to one end of the filament 80 to provide filament drive current, and an electrode 78 (filament 2 electrode) connected to the other end of the filament 80 to provide a high voltage common return. The electrodes are isolated from one another.

Figure 4:
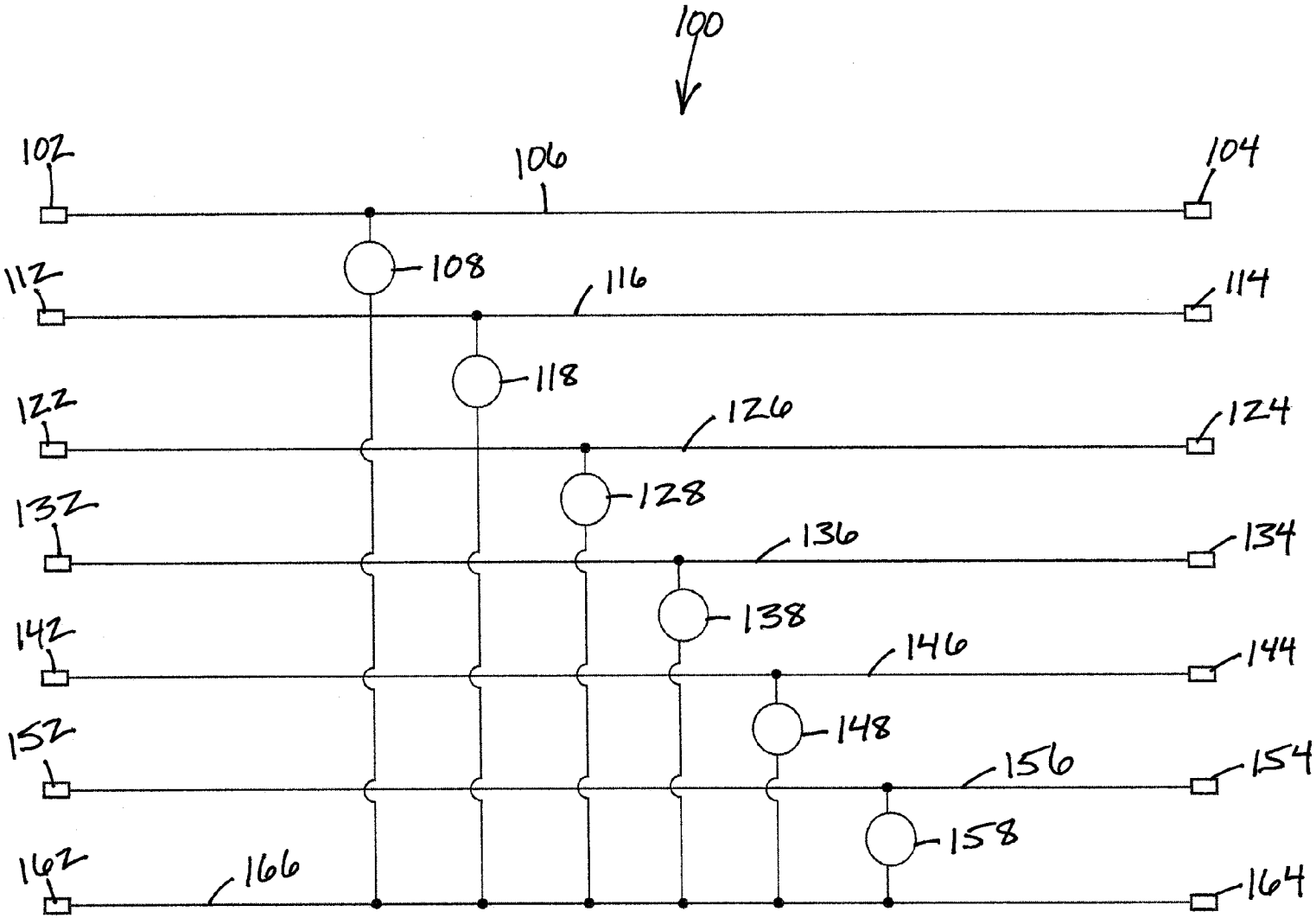
FIG. 4 is a schematic diagram of an exemplary embodiment of a high voltage transient suppression and spit protection circuit assembly for an x-ray generation system.
Figure 5:
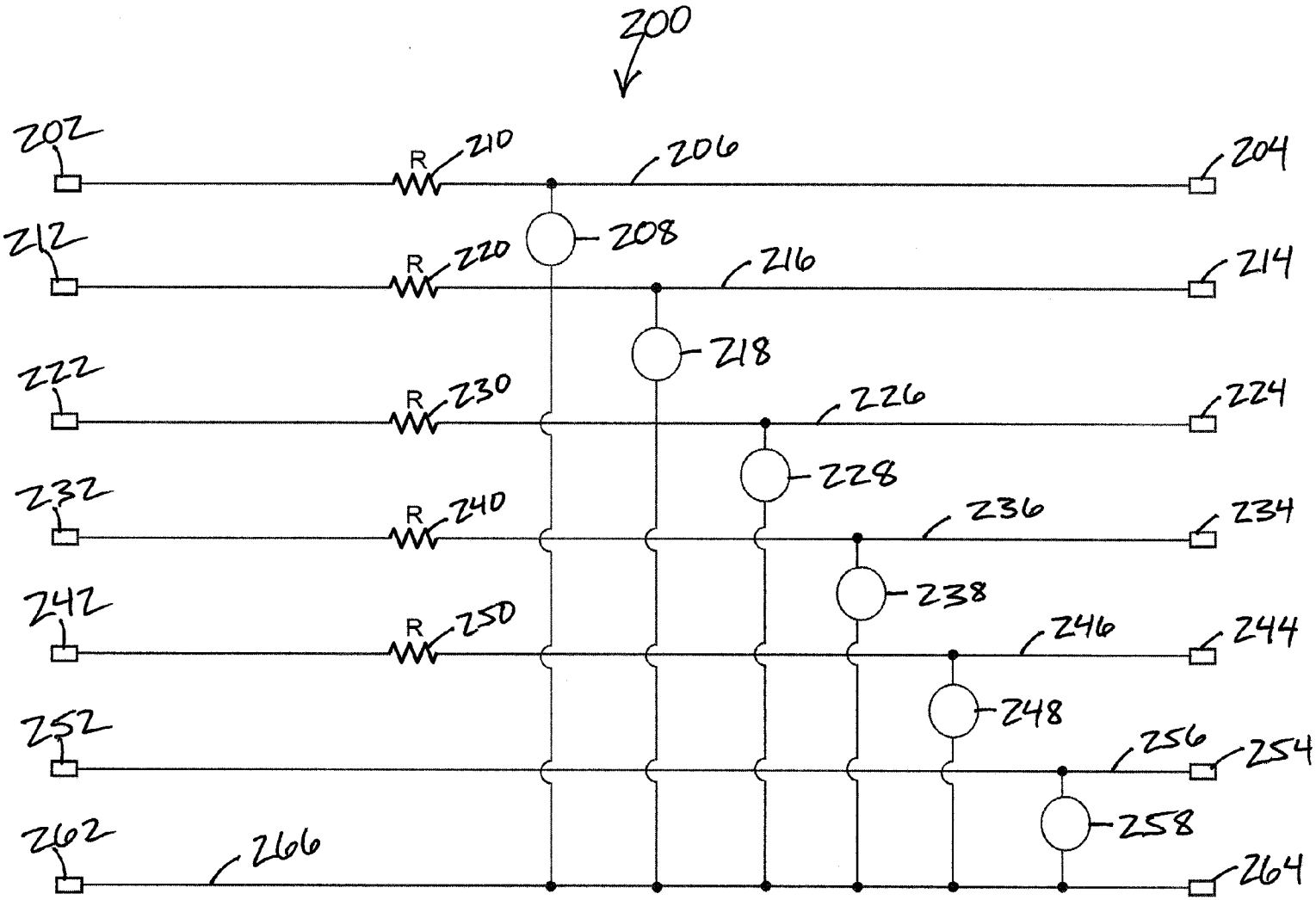
FIG. 5 is a schematic diagram of an exemplary embodiment of a high voltage transient suppression and spit protection circuit assembly for an x-ray generation system.

FIG. 4 is a schematic diagram of an exemplary embodiment of a high voltage transient suppression and spit protection circuit assembly 100 for an x-ray tube. The circuit assembly 100 includes a plurality of transient suppression devices (non-linear high voltage protection components) coupled to the bias control circuits. The circuit assembly 100 includes a transient suppression device coupled between each width 1, width 2, length 1, length 2 and focusing bias conductor and the high voltage common return conductor, and a transient suppression device coupled between the filament conductor and the high voltage common return. The plurality of transient suppression devices are designed to prevent high voltage transients from occurring and protect the high voltage generator 34, high voltage cable assembly 46, and the cathode assembly 38 from spits (vacuum discharges or vacuum arcs).

Examples of non-linear high voltage protection components or high voltage transient suppression devices acting as transient surge protectors include, but are not limited to diodes, DIACs, SIDACs, metal oxide varistors (MOVs), thyristors, SIDACtor® thyristors, avalanche diodes, transient voltage suppression (TVS) diodes, spark gaps, etc.

The high voltage transient suppression and spit protection circuit assembly 100 may be packaged within the high voltage generator 34, high voltage cable assembly 46, high voltage connectors 48, 50, x-ray tube vacuum housing 36, or as a stand-alone assembly connecting the high voltage generator 34 to the x-ray tube vacuum housing 36.

In the high voltage transient suppression and spit protection circuit assembly 100, a width 1 conductor 106 extends between a width 1 terminal 102 on the high voltage generator 34 and a width 1 terminal 104 on the cathode assembly 38, which is coupled to the width 1 electrode 66 on the cathode assembly 38 as shown in FIG. 3. A transient suppression device 108 is coupled between the width 1 conductor 106 (width 1 bias circuit in the high voltage generator) and a high voltage common return 166.

A width 2 conductor 116 extends between a width 2 terminal 112 on the high voltage generator 34 and a width 2 terminal 114 on the cathode assembly 38, which is coupled to the width 2 electrode 68 on the cathode assembly 38 as shown in FIG. 3. A transient suppression device 118 is coupled between the width 2 conductor 116 (width 2 bias circuit in the high voltage generator) and the high voltage common return 166.

A length 1 conductor 126 extends between a length 1 terminal 122 on the high voltage generator 34 and a length 1 terminal 124 on the cathode assembly 38, which is coupled to the length 1 electrode 70 on the cathode assembly 38 as shown in FIG. 3. A transient suppression device 128 is coupled between the length 1 conductor 126 (length 1 bias circuit in the high voltage generator) and the high voltage common return 166.

A length 2 conductor 136 extends between a length 2 terminal 132 on the high voltage generator 34 and a length 2 terminal 134 on the cathode assembly 38, which is coupled to the length 2 electrode 72 on the cathode assembly 38 as shown in FIG. 3. A transient suppression device 138 is coupled between the length 2 conductor 136 (length 2 bias circuit in the high voltage generator) and the high voltage common return 166.

A focusing conductor 146 extends between a focusing terminal 142 on the high voltage generator 34 and a focusing terminal 144 on the cathode assembly 38, which is coupled to the focusing electrode 74 on the cathode assembly 38 as shown in FIG. 3. A transient suppression device 148 is coupled between the focusing conductor 146 (focusing bias circuit in the high voltage generator) and the high voltage common return 166.

A filament conductor 156 extends between a filament terminal 152 on the high voltage generator 34 and a filament terminal 154 on the cathode assembly 38, which is coupled to the filament 1 electrode 76 on the cathode assembly 38 as shown in FIG. 3. A transient suppression device 158 is coupled between the filament conductor 156 (filament drive circuit in the high voltage generator) and the high voltage common return 166.

A high voltage common return conductor 166 extends between a high voltage common return terminal 162 on the high voltage generator 34 and a high voltage common return terminal 164 on the cathode assembly 38, which is coupled to the filament 2 electrode 78 on the cathode assembly 38 as shown in FIG. 3.

FIG. 5 is a schematic diagram of an exemplary embodiment of a high voltage transient suppression and spit protection circuit assembly 200 for an x-ray tube. The circuit assembly 200 includes a plurality of surge resistors and a plurality of transient suppression devices coupled to the bias control circuits. The circuit assembly 200 includes a surge resistor along with a transient suppression device coupled between each width 1, width 2, length 1, length 2 and focusing bias conductor and the high voltage common return conductor, and a transient suppression device coupled between the filament conductor and the high voltage common return. The plurality of surge resistors and plurality of transient suppression devices are designed to prevent high voltage transients from occurring and protect the high voltage generator 34, high voltage cable assembly 46, and the cathode assembly 38 from spits (vacuum discharges or vacuum arcs).

Examples of non-linear high voltage protection components or high voltage transient suppression devices acting as transient surge protectors include, but are not limited to diodes, DIACs, SIDACs, MOVs, thyristors, SIDACtor° thyristors, avalanche diodes, TVS diodes, spark gaps, etc.

The high voltage transient suppression and spit protection circuit assembly 200 may be packaged within the high voltage generator 34, high voltage cable assembly 46, high voltage connectors 48, 50, x-ray tube vacuum housing 36, or as a stand-alone assembly connecting the high voltage generator 34 to the x-ray tube vacuum housing 36.

In the high voltage transient suppression and spit protection circuit assembly 200, a width 1 conductor 206 extends between a width 1 terminal 202 on the high voltage generator 34 and a width 1 terminal 204 on the cathode assembly 38, which is coupled to the width 1 electrode 66 on the cathode assembly 38 as shown in FIG. 3. A surge resister 210 is in series with the width 1 conductor 206, and a transient suppression device 208 is coupled between the width 1 conductor 206 (width 1 bias circuit in the high voltage generator) and a high voltage common return 266.

A width 2 conductor 216 extends between a width 2 terminal 212 on the high voltage generator 34 and a width 2 terminal 214 on the cathode assembly 38, which is coupled to the width 2 electrode 68 on the cathode assembly 38 as shown in FIG. 3. A surge resister 220 is in series with the width 2 conductor 216, and a transient suppression device 218 is coupled between the width 2 conductor 216 (width 2 bias circuit in the high voltage generator) and the high voltage common return 266.

A length 1 conductor 226 extends between a length 1 terminal 222 on the high voltage generator 34 and a length 1 terminal 224 on the cathode assembly 38, which is coupled to the length 1 electrode 70 on the cathode assembly 38 as shown in FIG. 3. A surge resister 230 is in series with the length 1 conductor 226, and a transient suppression device 228 is coupled between the length 1 conductor 226 (length 1 bias circuit in the high voltage generator) and the high voltage common return 266.

A length 2 conductor 236 extends between a length 2 terminal 232 on the high voltage generator 34 and a length 2 terminal 234 on the cathode assembly 38, which is coupled to the length 2 electrode 72 on the cathode assembly 38 as shown in FIG. 3. A surge resister 240 is in series with the length 2 conductor 236, and a transient suppression device 238 is coupled between the length 2 conductor 236 (length 2 bias circuit in the high voltage generator) and the high voltage common return 266.

A focusing conductor 246 extends between a focusing terminal 242 on the high voltage generator 34 and a focusing terminal 244 on the cathode assembly 38, which is coupled to the focusing electrode 74 on the cathode assembly 38 as shown in FIG. 3. A surge resister 250 is in series with the focusing conductor 246, and a transient suppression device 248 is coupled between the focusing conductor 246 (focusing bias circuit in the high voltage generator) and the high voltage common return 266.

A filament conductor 256 extends between a filament terminal 252 on the high voltage generator 34 and a filament terminal 254 on the cathode assembly 38, which is coupled to the filament 1 electrode 76 on the cathode assembly 38 as shown in FIG. 3. A transient suppression device 258 is coupled between the filament conductor 256 (filament drive circuit in the high voltage generator) and the high voltage common return 266.

A high voltage common return conductor 266 extends between a high voltage common return terminal 262 on the high voltage generator 34 and a high voltage common return terminal 264 on the cathode assembly 38, which is coupled to the filament 2 electrode 78 on the cathode assembly 38 as shown in FIG. 3.

In an exemplary embodiment, a method for high voltage transient suppression and spit protection in an x-ray generation system comprises providing an electrical circuit in the x-ray generation system to suppress electrical transients in the x-ray generation system, reducing induced voltages in the x-ray generation system through limiting transient currents in the x-ray generation system by surge resistors, clamping transient voltages in the x-ray generation system through transient suppression devices or other non-linear protective components coupled to the x-ray generation system, and diverting potential high surge currents from entering high voltage generator circuitry in the x-ray generation system causing high voltage generator component failure.

The exemplary embodiments of high voltage transient suppression and spit protection circuitry systems and methods described above allow applying bias voltages to an x-ray generation system without loss of high voltage integrity due to high voltage transients caused by spits by containing transient voltages to acceptable levels and preventing potentially high surge currents from entering the high voltage generator of the x-ray generation system, thereby significantly improving the reliability of the x-ray generation system under transient conditions.

While the invention has been described with reference to various embodiments, those skilled in the art will appreciate that certain substitutions, alterations and omissions may be made to the embodiments without departing from the spirit of the invention. Accordingly, the foregoing description is meant to be exemplary only, and should not limit the scope of the invention as set forth in the following claims.

What is claimed is:

1. An x-ray generation system comprising:

an x-ray tube vacuum housing with a cathode assembly spaced apart from an anode assembly;

a high voltage generator coupled to the x-ray tube vacuum housing providing a plurality of bias voltages from a plurality of bias circuits for controlling an electron beam from the cathode assembly to a focal spot on the anode assembly;

a high voltage transient suppression and spit protection circuit assembly coupled between the high voltage generator and the x-ray tube vacuum housing for protection of the plurality of bias circuits within the x-ray generation system; and a high voltage cable assembly coupled between the high voltage generator and the x-ray tube vacuum housing, wherein the high voltage cable assembly includes a first high voltage connector attached to one end of the high voltage cable assembly for connecting the high voltage cable assembly to the high voltage generator and a second high voltage connector attached to the opposite end of the high voltage cable assembly for connecting the high voltage cable assembly to the x-ray tube vacuum housing.

2. The x-ray generation system of claim 1, wherein the high voltage cable assembly comprises a plurality of electrical conductors positioned within the cable assembly and extending therethrough, wherein the plurality of conductors comprises at least two conductors providing bias voltages to control the electron beam focal spot width, at least two conductors providing bias voltages to control the electron beam focal spot length, at least one conductor providing a bias voltage to control the electron beam focal spot focusing, at least one conductor providing filament drive current, and at least one conductor providing a high voltage common return.

3. The x-ray generation system of claim 1, wherein the high voltage transient suppression and spit protection circuit assembly is integrated within the high voltage cable assembly.

4. The x-ray generation system of claim 1, wherein the high voltage transient suppression and spit protection circuit assembly is integrated within the high voltage connectors.

5. The x-ray generation system of claim 1, wherein the electron beam focal spot is controlled and deflected electrostatically through the plurality of bias voltages supplied by the plurality of bias circuits in the high voltage generator and applied to a plurality of electrodes in the cathode assembly.

6. The x-ray generation system of claim 5, wherein the cathode assembly comprises a plurality of electrodes with a plurality of bias voltages applied to the plurality of electrodes, wherein the plurality of electrodes comprise at least two electrodes on opposite sides of a cathode filament to control the electron beam focal spot width, at least two electrodes on opposite ends of the cathode filament to control the electron beam focal spot length, at least one electrode to control electron beam focal spot focusing, an electrode connected to one end of the cathode filament to provide filament drive current, and an electrode connected to the opposite end of the cathode filament to provide a high voltage common return.

7. The x-ray generation system of claim 1, wherein the high voltage transient suppression and spit protection circuit assembly comprises at least one transient suppression device coupled between each bias circuit and a high voltage common return.

8. The x-ray generation system of claim 7, wherein the high voltage transient suppression and spit protection circuit assembly comprises at least one transient suppression device coupled between a filament drive circuit in the high voltage generator and the high voltage common return.

9. The x-ray generation system or the of claim 8, wherein the at least one transient suppression device comprises at least one of a diode, avalanche diode, transient voltage suppression (TVS) diode, SIDAC, metal oxide varistor (MOV), thyristor, SIDACtor® thyristor, and spark gap.

10. The x-ray generation system of claim 1, wherein the high voltage transient suppression and spit protection circuit assembly is integrated within the high voltage generator.

11. The x-ray generation system of claim 1, wherein the high voltage transient suppression and spit protection circuit assembly is integrated within the x-ray tube vacuum housing.

12. The x-ray generation system of claim 1, wherein the high voltage transient suppression and spit protection circuit assembly is integrated within an assembly connecting the high voltage generator to the x-ray tube vacuum housing.

* * * * *